US005838222A

United States Patent [19]

Al-Rawi

[11] Patent Number: 5,838,222

[45] Date of Patent: Nov. 17, 1998

[54] MULTITURN POTENTIOMETER

[75] Inventor: Steven Al-Rawi, Brea, Calif.

[73] Assignee: BI Technologies Corporation, Fullerton, Calif.

[21] Appl. No.: 931,629

[22] Filed: Sep. 16, 1997

Related U.S. Application Data

[63] Continuation of Ser. No. 587,155, Jan. 16, 1996, abandoned.

[51] Int. Cl.[6] ..... H01C 10/32

[52] U.S. Cl. ..... 338/198; 338/162; 338/173; 338/191

[56] References Cited

U.S. PATENT DOCUMENTS

| | | | |
|---|---|---|---|
| 1,387,433 | 8/1921 | Sundhaussen | 307/32 |
| 2,573,280 | 10/1951 | Schmidt | 323/228 |
| 2,786,122 | 3/1957 | Strain | 338/48 |
| 4,117,444 | 9/1978 | Hilreth et al. | 338/198 |
| 4,223,294 | 9/1980 | Moffitt et al. | 338/122 |
| 4,682,142 | 7/1987 | Lohner et al. | 338/172 |
| 5,075,604 | 12/1991 | Crook et al. | 318/17 |
| 5,200,747 | 4/1993 | Betz et al. | 338/171 |

*Primary Examiner*—Michael L. Gellner
*Assistant Examiner*—Karl Easthom

[57] ABSTRACT

An improved multiturn potentiometer consists of a rotor assembly including a wiper in electrical contact with an output terminal and an annular resistance strip. The annular resistance strip is electrically connected to a source of potential through one or more potentiometric rotary switches which are activated periodically change the magnitude of potential to the annular resistance strip. Movement of the wiper along the annular resistance strip varies the potential to the output terminal. Activation of the rotary switches is effected by rotation of the rotor assembly and increases or decreases the potential to the annular resistance strip depending on the direction of rotation. Each potentiometric rotary switch is capable of multiple variations of potential so that each revolution of the rotor assembly effects movement of the rotary switch to supply a new potential to the annular resistance strip. As the wiper moves along the annular resistance strip the signal to the output terminal is interpolation of the potential of the annular resistance strip. In one embodiment there are three switches spaced about the annular resistance strip and the annular resistance strip is divided into three segments, each of which are connected to one of the switches. Each switch has seven positions for variation of potential.

14 Claims, 7 Drawing Sheets

MULTITURN POTENTIOMETER

This application is a continuation of application Ser. No. 08/587,155, filed Jan. 16, 1996, now abandoned.

BACKGROUND OF THE INVENTION

Multiturn potentiometers are preferred for many applications because they have the capacity to output a higher useable resolution as compared to a single turn potentiometer which is limited to a resolution that can be achieved in a single turn. Multiturn potentiometer normally use some form of mechanical arrangement to move a contact along a helical coil or a resistance path. As a result multiturn potentiometer are relatively expensive to produce as compared to a single turn potentiometer and typically multiturn potentiometer have limited mechanical travel. Multiturn potentiometer also can exhibit dithering or backlash. Dithering is a fluctuation in potential output that can be caused by minor back and forth movement of the potentiometer rotor wiper on the resistance element, such as may be caused by vibration. Backlash is defined as the maximum difference in contact position when the drive shaft is moved to the same actual output position from opposite directions. Backlash is caused by lost motion between two or more members arranged for transmission of motion from one to the other when direction of movement is reversed. This can be due to necessary clearances or friction, such as between an electric contact and a helical coil. Backlash usually increases as the respective members wear at their points of mutual contact resulting in greater looseness and inaccuracy. Both dithering and backlash are particularly undesirable characteristics in precision potentiometer in which the contact must be precisely moved to a particular point on the resistance path to output a particular potential and precisely hold that potential.

Examples of multiturn potentiometer of the general type discussed above can be found in U.S. Pat. Nos. 3,469,225; 3,833,783; 4,459,711; 4,110,721 and 4,716,395. U.S. Pat. No. 3,426,307 describes efforts to overcome the backlash problem encountered with multiturn potentiometer.

SUMMARY OF THE INVENTION

The present invention addresses the problems encountered with multiturn potentiometer and relates to potentiometer that provide the simplicity of construction found in single turn potentiometer but also provide the high resolution of signal output associated with multiturn potentiometer.

In accordance with the invention there is provided an improved multiturn potentiometer comprising a housing defining an interior and having circuit means including an output terminal and a first resistance element electrically connected to the output terminal. At least one other resistive element is provided which is in electrical contact with a source of electrical potential. A rotor assembly is rotatably mounted in the housing interior and a wiper is carried by the rotor assembly to complete an electrical circuit between the output terminal and the first resistance element. The wiper is movable along the first resistance element to vary the output potential as the rotor assembly is rotated in the housing. At least one switch in the housing completes a circuit between the first resistance element and the other resistive element or elements. The switch includes a contact for movement on the other resistive element to periodically modify the magnitude of potential to the first resistance element responsive to the rotation of the rotor assembly. Means, such as a drive shaft is provided for rotating the rotor assembly.

In operation the first resistance element is maintained at a selected potential through electrical contact with a resistive element and rotation of the rotor assembly in one direction moves the wiper along the first resistance element to provide a succession of increasing increments of the potential to the output terminal and movement in the opposite direction provides a succession of decreasing increments of the potential. The switch is periodically activated by rotation of the rotor assembly to modify the magnitude of potential to the first resistance element.

The invention will be more fully understood from the following description of the preferred embodiment of the invention taken in conjunction with the drawings.

DESCRIPTION OF THE PREFERRED EMBODIMENT

Figure 1:
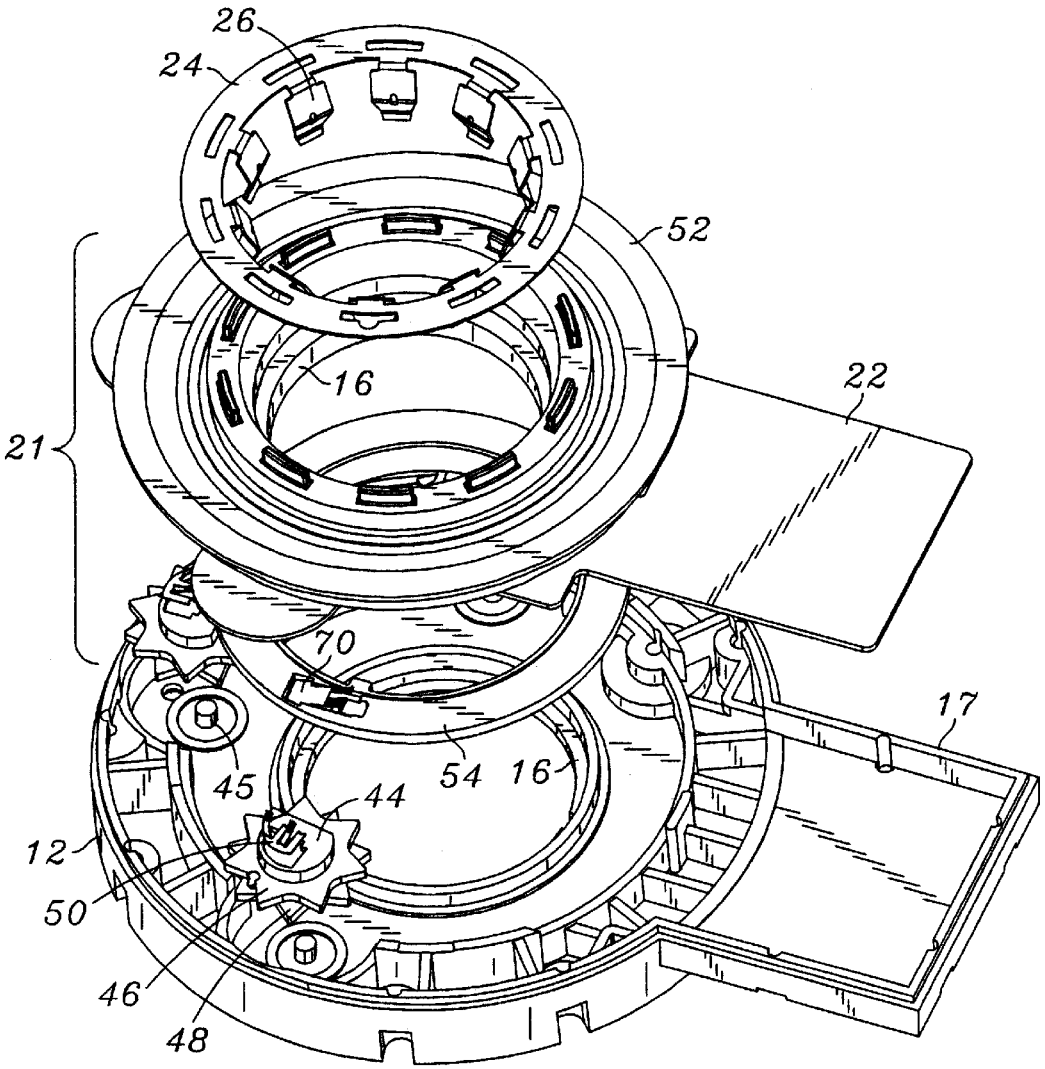
FIG. 1 is an exploded view, without the upper housing member of a potentiometer constructed in accordance with the invention.
Figure 2:
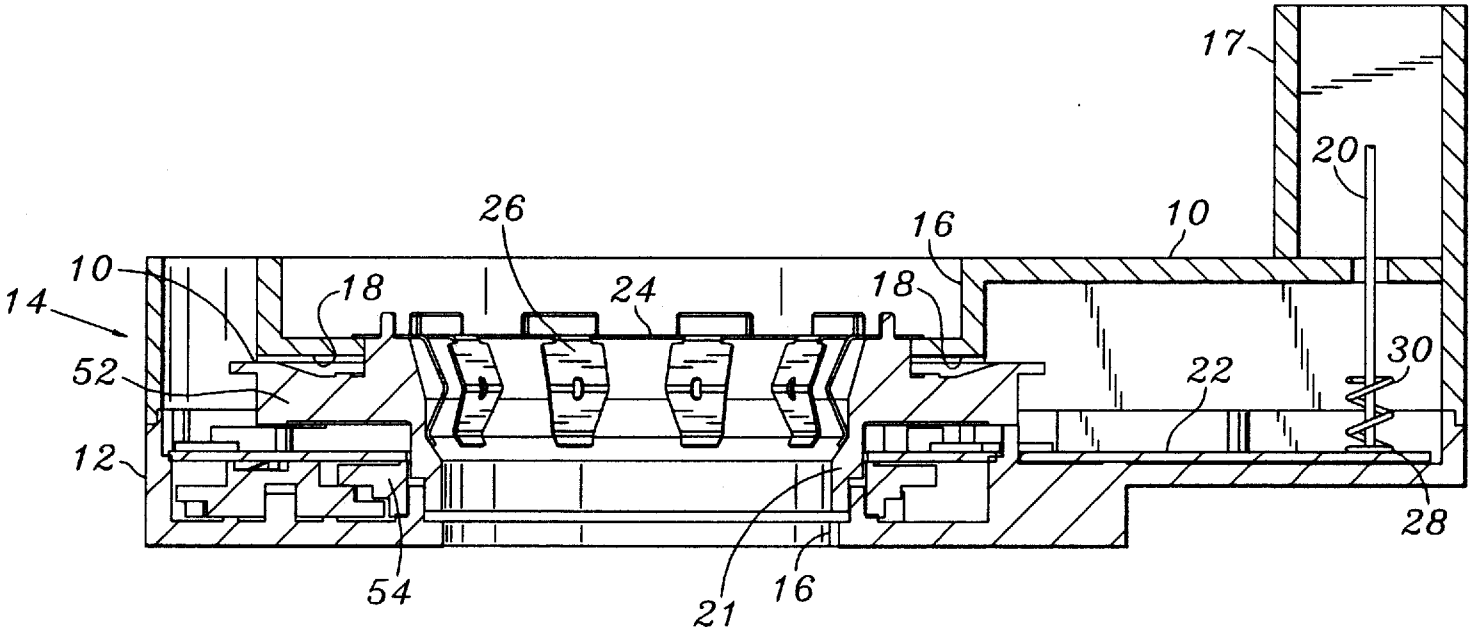
FIG. 2 is a side section elevation of the device of FIG. 1 fully assembled.

The potentiometer shown in FIGS. 1 and 2 consists of an upper and lower housing member 10 and 12 which form a potentiometer housing 14 which defines the interior of the potentiometer. As shown the upper and lower housings members, 10 and 12, are annularly shaped and provided with central openings which are aligned when the upper and lower housing members are joined to define the upper and lower-opening of a center passage 16 which extends through the interior of the housing assembly 14. The potentiometer illustrated in FIG. 1 is adapted to be used to determine the position of a point on a rotatable shaft which is rotatably received in the center passage 16 and on which the annular potentiometer is mounted. It will be clear, however, that the potentiometer of the present invention is not limited to annular form and may be operated by a small drive shaft or the like which is utilized to operate the potentiometer. A portion of the upper housing member 10 and the lower housing member 12 is elongated and a perpendicularly extending open ended terminal pin housing 17 is formed on the upper housing member to receive a series of terminal pins 20. A rotor assembly 21, consisting of of an upper component 52 and a lower component 54 is coaxially, rotatably mounted in the interior of the housing 14. A locking ring 24 carrying resilient gripping fingers 26 is mounted on the rotor assembly 21 for grasping a drive shaft (not shown) so that the rotor assembly rotates with the shaft for operation of the potentiometer.

As mentioned above, the embodiment illustrated receives a rotable drive shaft through the center passage 16 and as the shaft rotates the rotor assembly 21 also rotates which creates changes in resistance and thus, the potential output by the potentiometer. Switching means are provided in order to increase or decrease voltage depending upon the relative position of a point on the rotating shaft. The extending terminal pins 20 are adapted for connecting the potentiometer through suitable circuitry to a controller (not shown) for receiving the potentiometer's signal and utilizing that signal in the control of a process. One illustrative application for such a device is in a steering wheel turns application for automobiles in which the number of turns of the steering wheel is sensed by the potentiometer which outputs a representative voltage signal to a controller. The potentiometer of the invention finds use in any application requiring the precision control of voltage by a potentiometer.

Figure 3:
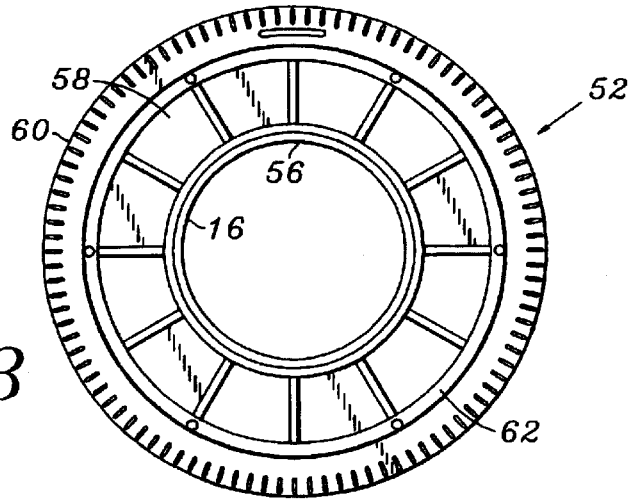
FIG. 3 is a top plan view of the upper section of the rotor assembly of the device shown in FIG. 1.
Figure 4:
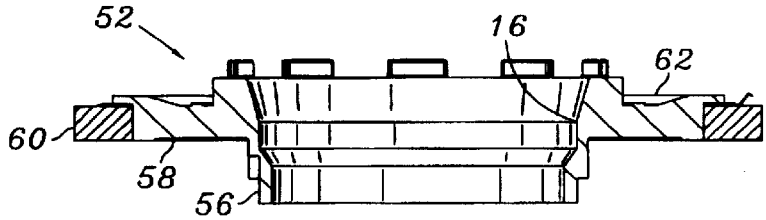
FIG. 4 is a side section of FIG. 3 taken along line 4—4.

As shown in greater detail in FIGS. 2, 3, and 4, the housing 14, which is formed from the upper housing member 10 and the lower housing member 12, defines an interior and the upper and lower opening of the center passage 16 through which a rotatable shaft (not shown) can extend. A portion of the upper housing member 10 surrounding the central opening is turned downwardly to define the upper end portion of the center passage 16 and is turned radially inwardly to define a clamping surface 18 for securing the rotor assembly 21 in cooperation with the lower housing member 12. A substrate 22 is disposed in the housing 14 on which is screened the circuitry for the potentiometer. The required resistors and output terminals 28 are also carried on the substrate 22. Surrounding each of the output terminals 28 is a helical spring 30 which is affixed to the substrate 22 in electrical contact with its respective output terminal 28 to form a resilient conductive socket for a terminal pin 20. Each of the terminal pins 20 extend through corresponding openings 32 in the upper housing member 10 and the terminal pins 20 are supported in their upright position by the upper body member 10. The extending ends of the terminal pins 20 terminate within the terminal pin housing 17 defined on the upper member 10. The terminal pin housing 17 is open at its upper end to receive a plug for providing electrical connection from the circuitry of the potentiometer to a suitable controlling device (not shown) through the terminal pins 20.

Figure 7:
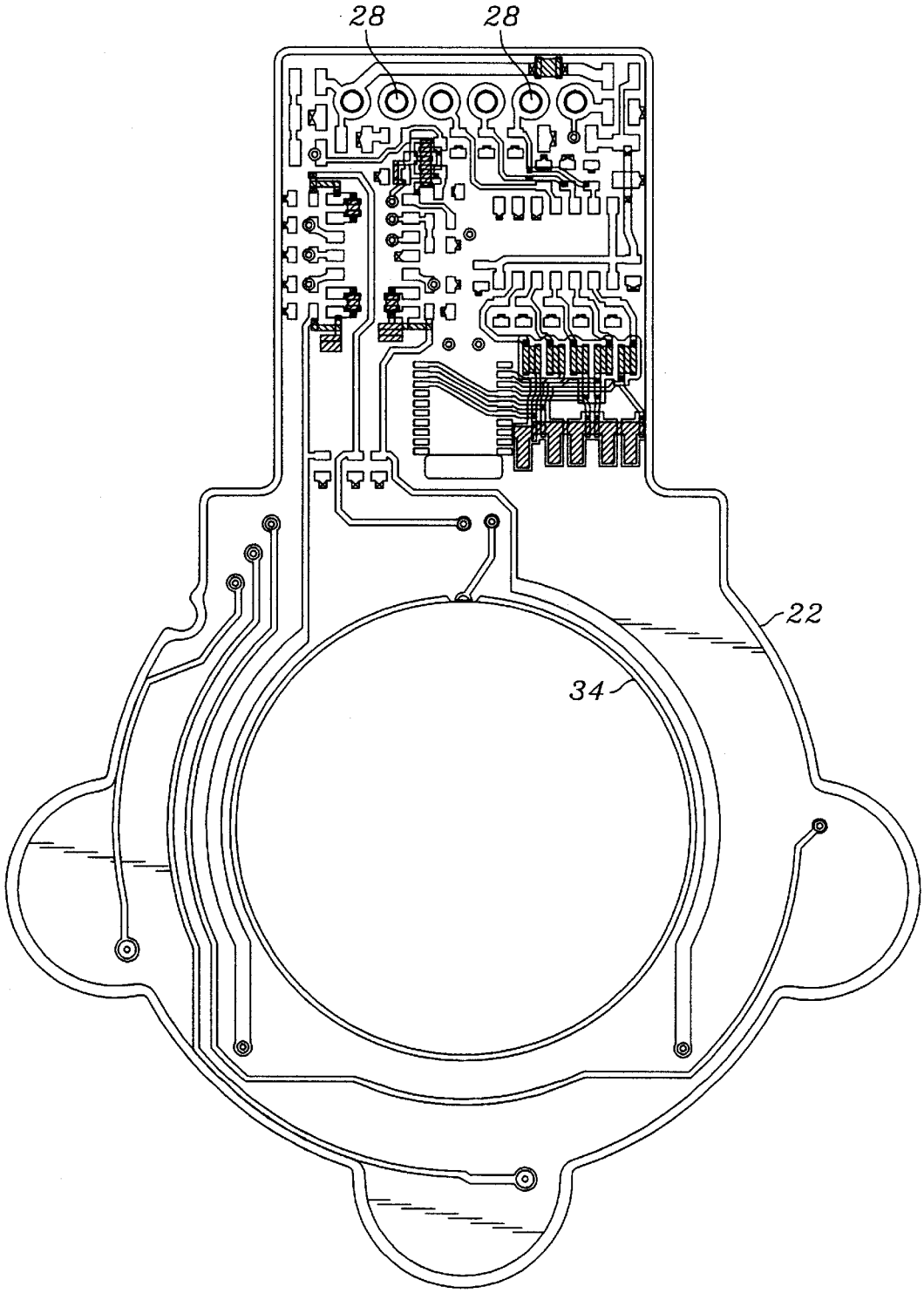
FIG. 7 is a top plan view of the substrate of a device constructed in accordance with the invention.
Figure 8:
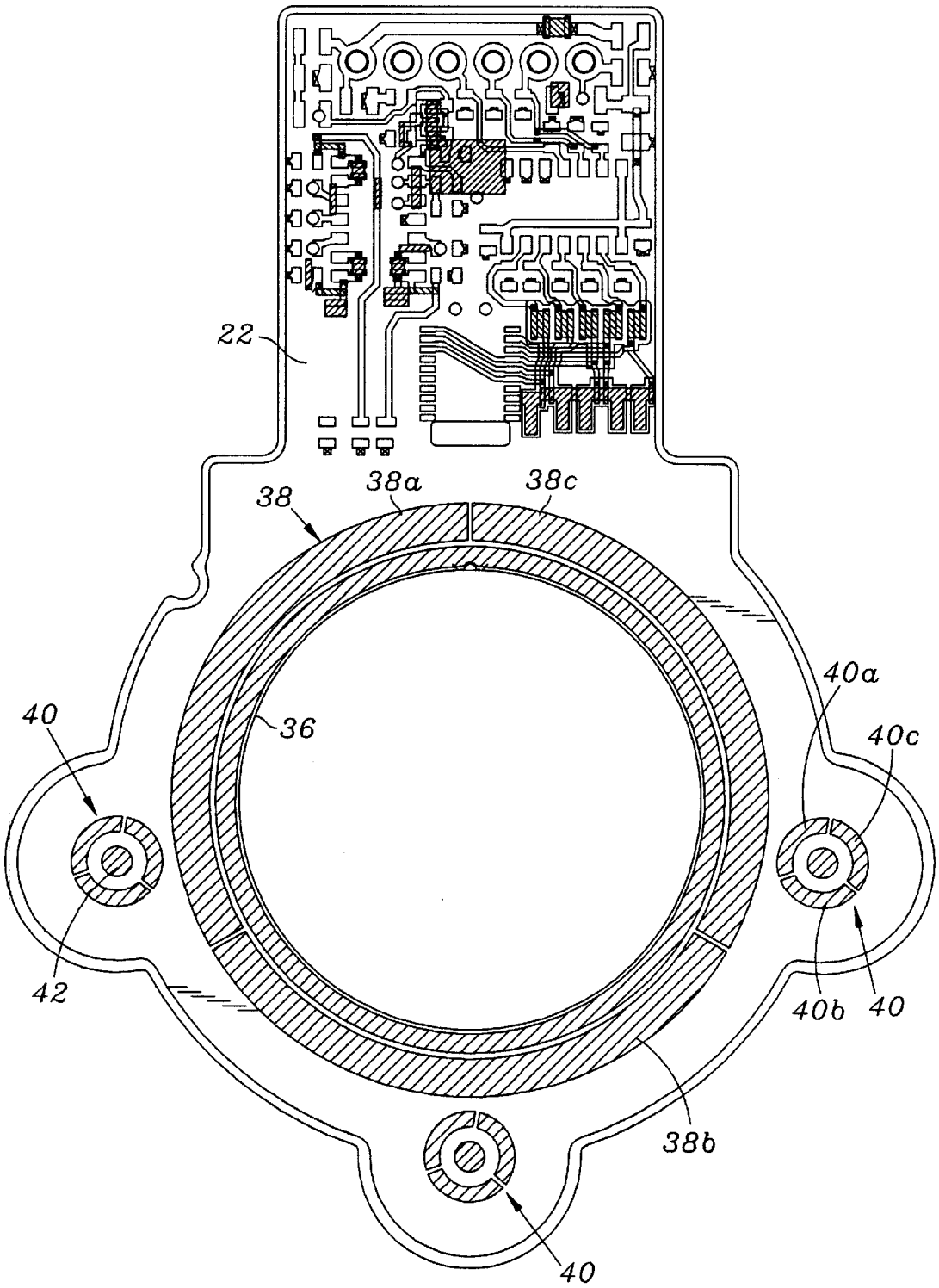
FIG. 8 is a bottom plan view of the substrate of FIG. 7.

As more clearly shown in FIGS. 7 and 8, the substrate 22 is configured to be received in the housing and is provided with an opening 34 which forms part of the center passage 16 in the housing 14. The substrate 22 is formed of any printed circuit material, such as alumina, epoxy or polyester imide resin, and the circuitry is screened on in a conventional fashion. As is most clearly shown in FIG. 8, the undersurface of the substrate 22, the surface facing the lower housing member 12, is provided with a conductor ring 36 immediately adjacent the periphery of the opening 34 and a coaxial resistive annular strip 38 which is divided into three segments 38*a*, 38*b*, and 38*c*. Three smaller switching annuli 40 are disposed on the undersurface of the substrate 22 in radially spaced relationship to each other and to the resistive annular strip 38. The location and the spacing of the annuli 40 is not critical and are dependent on the location of the switching means and the size and location of the segments 38*a*, 38*b* and 38*c*. As shown, the segements 38*a*, 38*b* and 38*c* are of equal length and the annuli are equally spaced apart. A conductive button 42 is disposed in the center of each of the switching annuli 40.

Figure 9:
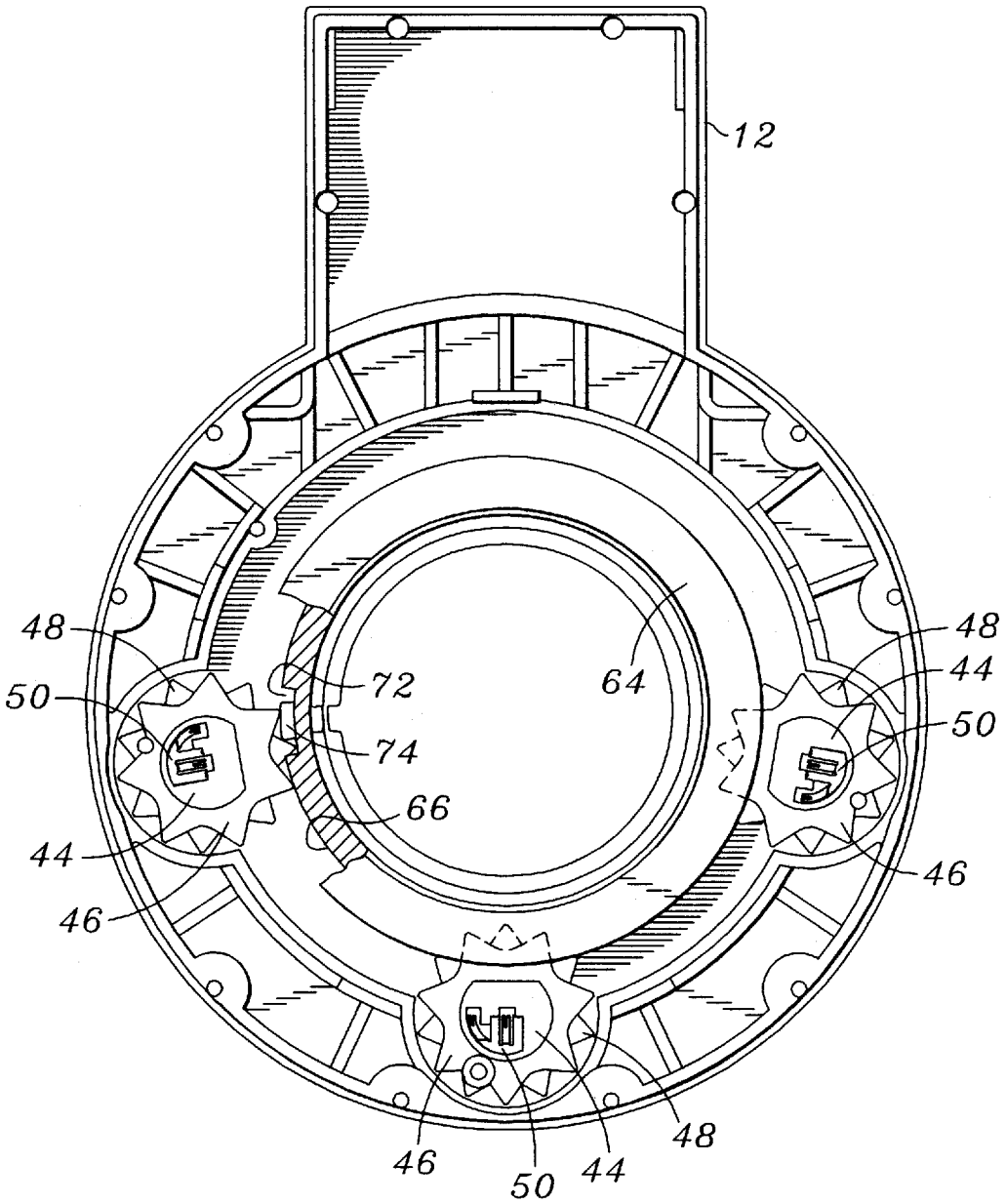
FIG. 9 is a top plan view of the lower section of the rotor assembly of the device shown in FIG. 1 with the lower rotor component installed.

In FIG. 9, three rotary switching members 44 are mounted in the lower housing on posts 45 and each is aligned with a corresponding one of the switching annuli 40 to form a potentiometric switch. Each of the rotary switching members 44 consists of an upper star-shaped section 46 and a lower star-shaped section 48. Each of sections 46 and 48 contains an equal number of arms. The number of arms is equal to the number of switching positions provided by the rotary switching members 44. In the embodiment illustrated, the rotary switching members have seven switching positions, thus there are seven arms on each star-shaped section 46 and 48. The arms of the upper star-shaped section 46 are angularly offset with respect to those of the lower section 48. Each of the upper sections 46 of the rotary switching members 44 contains a contact 50 for completing a circuit between one of the segments, 40*a*, 40*b* or 40*c* of the smaller switching annuli 40 and the conductive button 42 as the switch is rotated.

Figure 5:
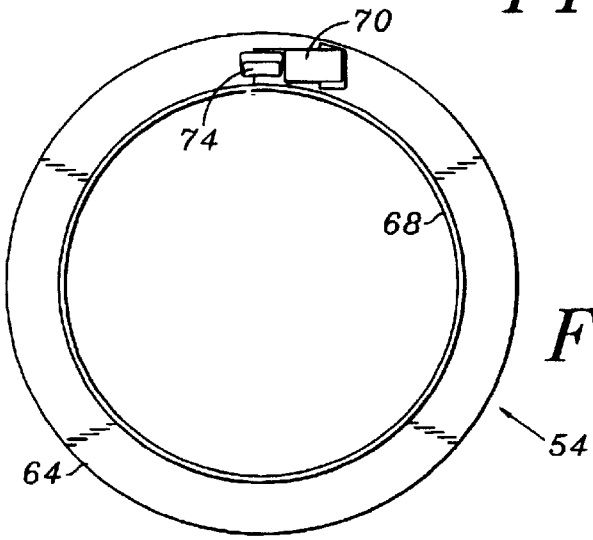
FIG. 5 is a top plan view of the lower section of the rotor assembly of the device shown in FIG. 1.
Figure 6:
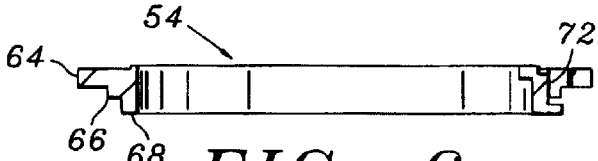
FIG. 6 is a side sectional view of FIG. 5 taken along line 6—6.

Referring to FIGS. 3, 4, 5 and 6, the rotor assembly 21 consists of upper and lower componants 52 and 54. The upper component 52 in the embodiment illustrated includes a central cylinder 56 which extends into the interior of the housing 14. The bore of central cylinder 56 defines a portion of the center passage 16 of the housing 14. An annular collar 58 is formed on the central cylinder 56 and, in the embodiment shown, carries at its outer edge an annular magnet 60 which is used as part of a digital output device (not shown), the form and function of which does not form a part of the present invention. The annular collar 58 defines an upper surface 62 which slidingly bears against the lower surface of the clamping member 18 of the upper housing. The central cylinder 56 extends through the lower housing member 12 and terminates adjacent the periphery of the center passage 16 therein. The diameter of the center passage 16 in the housing member 12 is smaller than the diameter of the central cylinder 56 and the surrounding portion of the housing member 12 defines a low friction bearing surface for the bottom edge of the central cylinder 56. The rotor assembly 21 is completed by the lower component 54, which is also referred to as the potentiometer rotor. The potentiometer rotor 54 is fitted over the bottom end of the central cylinder 56 of the upper housing member 10 for rotation therewith. The potentiometer rotor 54 describes three concentric overlying annular sections of decreasing outside diameter, the upper section 64 having the largest outside diameter, the middle section 66 the next largest and the lower section 68 having the smallest outside diameter. The top section 64 defines an upper surface which is immediately adjacent to the conductor ring 36 and the resistive annular strip 38 of the substrate 22. A wiper 70 on the upper surface makes electrical contact between the conductor ring 36 and the annular resistive strip 38 as the potentiometer rotor 54 rotates. The outside diameter of the lower section 68 is such that the outer surface of the lower section is immediately proximate the inwardly extending arms of the lower star-shaped sections 48 of the rotary switching members 44, while the outer surface of the middle section 66 is immediately proximate the inwardly extending arms of the upper star-shaped section 68. Thus, the rotor assembly 21 is free to rotate in the housing 14 while the switching rotors 44 are prevented from rotation because of the proximity of the wall of the middle section 66 to the arms of the upper star section. A slot 72 extends through the upper section 64 and middle section 66 of the potentiometer rotor 54 and a lug 74 is formed on the lower section 68 in alignment with the slot 72. FIG. 5 shows lug 74 in a top view looking down through an opening next to wiper 70. The slot 72 provides clearance into which a point of the upper star-shaped section 46 of a switching member 50 can extend to provide the clearance to permit rotation of the switching member responsive to contact between the point of the lower star-shaped section 48 of the switching member and the lug 74 as the rotor assembly 21 rotates.

Figure 10:
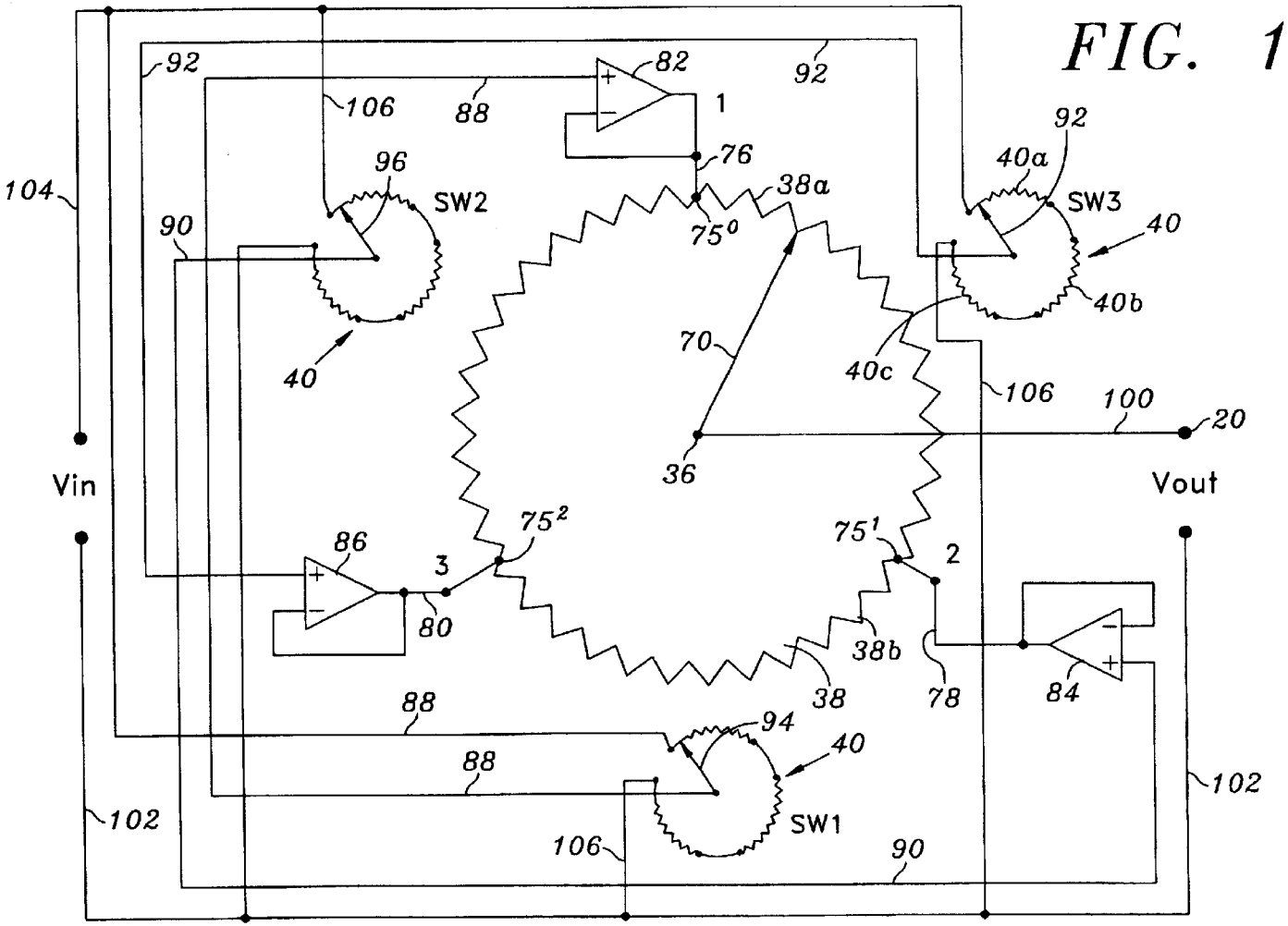
FIG. 10 is a simplified schematic diagram of the circuitry of the device shown in FIG. 1.

FIG. 10, is schematic diagram illustrating the circuitry of the potentiometer of the invention. As shown, the annular resistance strip 38 is provided with taps $75^0$, $75^1$ and $75^2$ for electrical connection through lines 76, 78, and 80 to operational amplifiers 82, 84 and 86, each of which are also electrically connected to a corresponding one of the smaller switching annuli 40. The taps $75^0$, $75^1$ and $75^2$ define the boundaries of the segments 38*a*, 38*b* and 38*c* and the voltage at each tap is different. Therefore, the voltage in each of the segments 38*a*, 38*b* and 38*c* is an interpolation of the tap voltage at its boundaries. The rotary switching members 44 are schematically illustrated as contacts 92, 94 and 96 which are in electrical contact with a corresponding one of the switching annuli 40 and a corresponding one of the operational amplifiers 82, 84 and 86. Lines 88, 90 and 92 connect operational amplifiers 82, 84 and 86 to a corresponding one of the switching annuli 40. The wiper 70 connects the annular resistive strip 38 and the conductor ring 36 and the output is conducted through lines 100 and 102 to terminal pins 20. Power input to the switching annuli 40 is through a circuit defined by lines 102, 104 and 106.

As shown in FIG. 10, the wiper 70 is illustrated as positioned in segment 38*a* to output an increment of the segment voltage as defined between taps $75^0$ and $75^1$. As the wiper rotates towards segment 38*b* (the next higher voltage segment), contact 96 is moved along the annulus 40, as described above, to a next higher voltage and thus sets tap $75^2$, through operational amplifier 86, to a higher voltage. It will be seen that contacts 92 and 94, which control the tap voltages of boundary taps $75^0$ and $75^1$ of segment 38*a* are not moved while the wiper 70 is in segment 38*a*. This increases the reliability of the output from the potentiometer and eliminates switching noise because the rotary switching members are never moved while their output is active. As the wiper 70 moves into segment 38*b*, taps $75^1$ and $75^2$ become the active taps and contact 92 is moved to a higher voltage on its annulus 40. Reversing the direction of wiper 70 results in reducing tap voltages in the manner described. From the foregoing it will be seen that the potentiometer is capable of precise voltage output with a minimum of output noise because of the buffering effect of the operational amplifiers. In addition, the rotary switching members are not moved while their output is active thus further reducing output noise and assuring reliability. The rotation period of the potentiometer of the present invention is equivalent to a multiturn potentiometer and has a rotational period greater than 360° provided by the successive switching of voltages at the taps.

As will be understood by those skilled in the art, various arrangements which lie within the spirit and scope of the invention other than those described in detail in the specification will occur to those persons skilled in the art. It is therefore to be understood that the invention is to be limited only by the claims appended hereto.

Having described the invention I claim:

1. A multiturn potentiometer comprising:

a. a housing defining an interior;

b. circuit means including an output terminal and a first resistance element electrically connected to said output terminal, at least one other resistive element in electrical contact with a source of electrical potential;

c. a rotor assembly rotatably mounted in said housing interior, a wiper carried by said rotor assembly in electrical contact with said output terminal and said first resistance element and movable along said first resistance element as said rotor assembly is rotated in said housing;

d. at least one switch in said housing in electrical contact with said first resistance element and said are other resistive element, said switch including a contact for movement on said other resistive element to modify the magnitude of potential to said first resistance element responsive to the rotation of said rotor assembly;

e. means for rotating said rotor assembly; and f. means carried by said rotor assembly and rotatable therewith for engaging said switch to move the contact thereof;

whereby said first resistance element is maintained within a potential range at a selected potential point and rotation of said rotor assembly in one direction moves said wiper along said first resistance element to provide a succession of increasing increments of said potential to said output terminal and movement in the opposite direction provides a succession of decreasing increments of said potential and said switch is activated by rotation of said rotor assembly to modify the magnitude of said potential point.

2. The multiturn potentiometer of claim 1 wherein said housing comprises upper and lower housing members which cooperate to rotatably secure said rotor assembly in said interior of said housing.

3. The multiturn potentiometer of claim 2 wherein said upper and lower housing members are provided with openings which are aligned when said upper and lower housing members are joined to define an upper and lower opening of a center passage extending through said housing.

4. The multiturn potentiometer of claim 1 wherein said circuit means comprises a substrate disposed in said housing defining an upper and lower face and a center opening aligned with said openings of said upper and lower housing members, said upper face having circuitry and output terminals disposed thereon, said lower face having disposed thereon said first resistance element comprising an annular strip of conductive material, a conductor ring concentrically located with respect to said first resistance element, at least one other resistive element disposed on said lower face in electrical contact with a source of potential and a terminal in electrical contact with said resistive annular strip.

5. The multiturn potentiometer of claim 4 wherein said first resistive element is divided into segments, each said segment in electrical contact with a corresponding one of said other resistive elements and each of said segments being maintained at a different potential.

6. The multiturn potentiometer of claim 1 wherein said rotor assembly consists of an upper component and a lower component, said upper component comprises a central cylinder having a bore and defining an upper and a lower end, said cylinder extending into the interior of said housing, said bore of said central cylinder defining a portion of said center passage, an annular collar having an upper surface is formed on said cylinder, said upper surface of said collar slidably contacting a surface of said upper housing member for rotation of said upper component in said housing, said lower component of said rotor assembly comprising an annular body fitted over said lower end of said central cylinder for rotation therewith.

7. The multiturn potentiometer of claim 6 wherein a portion of the upper housing member surrounding said opening is extended downwardly and turned radially inwardly to define said surface in sliding contact with said upper surface of said annular collar.

8. The multiturn potentiometer of claim 1 further comprising three of said potentiometric switches including three of said other resistive elements disposed on said substrate in spaced relationship to said first resistance element, a corresponding one of said switch bodies rotatably carried in said housing for electrical contact with each one of said other resistive elements to form an electrical circuit between said other resistive element and said first resistance element.

9. The multiturn potentiometer of claim 8 wherein said three other resistive elements and said corresponding switches are equally spaced apart about said center passage.

10. A multiturn potentiometer comprising:

a. a housing defining an interior, said housing comprising an upper and a lower housing member which cooperate to rotatably secure a rotor assembly in said housing interior;

b. said rotor assembly including a radially outwardly extending lug rotatably mounted in said housing interior;

c. circuit means in said housing including an output terminal and a first resistance element electrically connected to said output terminal, at least one resistive annulus consisting of a strip of conductive material defining an annulus, said annulus being in electrical contact with a source of potential and having a terminal in electrical contact with said first resistance element, said terminal being located at the center of said annulus, a wiper carried by said rotor assembly in electrical contact with said output terminal and said first resistance element and movable along said first resistance element as said rotor assembly is rotated in said housing;

d. at least one switch, said switch comprising a switch body rotatably mounted in said lower housing member proximate to and aligned with said resistive annulus, said switch body including at least one extending portion for engagement with said lug on said rotor assembly to rotate said switch body responsive to the rotation of said rotor assembly, said switch body being in electrical contact with said first resistance element and said resistive annulus and having a contact for movement on said resistive annulus to modify the magnitude of potential to said first resistance element responsive to the rotation of said switch;

whereby said first resistance element is maintained within a potential range at a selected potential point and rotation of said rotor assembly in one direction moves said wiper along said first resistance element to provide a succession of increasing increments of said potential to said output terminal and movement in the opposite direction provides a succession of decreasing increments of said potential and said switch is activated by rotation of said rotor assembly to modify the magnitude of said potential point.

11. The multiturn potentiometer of claim 10 wherein said switch body carries a plurality of radially extending arms, said arms defining end portions for contact with said extending lug of said rotor assembly.

12. The multiturn potentiometer of claim 11 wherein said switch body consists of an upper section and a lower section, each section containing an equal number of radially extending arms, said arms of said upper section being angularly misaligned with respect to said arms of said lower section, said lower component of said rotor assembly consisting of an annular body describing first, second and third concentric sections of decreasing outside diameter, said third concentric section having the smallest outside diameter and said first concentric section having the largest outside diameter, a slot formed in said second concentric section and a lug on said third concentric section aligned with said slot, said radially extending arms of said lower section terminating adjacent said third concentric section and said radially extending arms of said upper section terminating adjacent said second concentric section, whereby rotation of said switch body is normally prevented and occurs only as said lug contacts an end portion of an arm on said lower section and said slot is aligned to receive end portions of said arms of said upper section of said switch body.

13. An multiturn potentiometer comprising:

an annular housing defining an interior;

circuit means including an output terminal and a first resistance element electrically connected to said output terminal, first, second and third resistive switching annuli in electrical contact with a source of electrical potential;

a rotor having a through running passage mounted in said housing for rotation therein, a wiper carried by said rotor assembly in electrical contact with said output terminal and said first resistance element and movable along said first resistance element as said rotor assembly is rotated in said housing;

three rotary switches in said housing, each of said switches aligned with a corresponding one of said first, second and third resistive switching annuli for completing an electrical circuit between said first resistance element and a one of said switching annuli when one of said switches is activated to modify the magnitude of potential to said first resistance element responsive to the rotation of said rotor assembly;

means for rotating said rotor assembly; and means carried by said rotor assembly and rotatable therewith for activating said switches;

whereby said first resistance element is maintained within a potential range at a selected potential point and rotation of said rotor assembly in one direction moves said wiper along said first resistance element to provide a succession of increasing increments of said potential to said output terminal and movement in the opposite direction provides a succession of decreasing increments of said potential and said switch is activated by rotation of said rotor assembly to modify the magnitude of said potential point.

14. The multiturn potentiometer of claim 13 wherein a drive shaft extends through said passage in said rotor and rotation of said drive shaft causes rotation of said rotor in said housing.

* * * * *

UNITED STATES PATENT AND TRADEMARK OFFICE

CERTIFICATE OF CORRECTION

PATENT NO : 5,838,222

DATED : NOVEMBER 17, 1998

INVENTOR(S) : STEVEN AL-RAWI

It is certified that error appears in the above-identified patent and that said Letters Patent is hereby corrected as shown below:

CLAIM 1, COL. 6, LINE 6, DELETE "ARE" AFTER "SAID" AND INSERT – ONE–.

Signed and Sealed this

Twenty-third Day of March, 1999

*Attest:*

*Attesting Officer*

Q. TODD DICKINSON

*Acting Commissioner of Patents and Trademarks*